United States Patent [19]

Shibata et al.

[11] Patent Number: 4,971,634

[45] Date of Patent: Nov. 20, 1990

[54] METHOD OF CARBURIZING SPHEROIDIZING AND QUENCHING

[75] Inventors: Shinya Shibata; Yoshihisa Miwa, both of Hiroshima; Yoshihiko Kojima, Higashi-Hiroshima; Yukio Arimi, Hiroshima, all of Japan

[73] Assignee: Mazda Motor Corporation, Hiroshima, Japan

[21] Appl. No.: 384,765

[22] Filed: Jul. 25, 1989

[30] Foreign Application Priority Data

Jul. 25, 1988 [JP] Japan ..... 63-185177

[51] Int. Cl.[5] ..... C23C 8/23; C23C 8/32

[52] U.S. Cl. ..... 148/16.5; 148/16.6

[58] Field of Search ..... 148/16.5, 16.6

[56] References Cited

U.S. PATENT DOCUMENTS 2,260,249 8/1939 Harder ..... 148/16.5

4,202,710 5/1980 Naito et al. ..... 148/16.5

4,836,864 6/1989 Murakami et al. ..... 148/16.5

4,921,025 5/1990 Tipton et al. ..... 148/16.5

*Primary Examiner*—Theodore Morris

*Assistant Examiner*—Margery S. Phipps

*Attorney, Agent, or Firm*—Wenderoth, Lind & Ponack

[57] ABSTRACT

A method of carburizing and quenching involves the following three steps of: pre-carburizing a steel member containing Cr with precipitating carbide by heating to achieve a surface carbon concentration of not less than 1%; spheroidizing the carbide obtained by alternately holding the steel member at a temperature slightly above and slightly below the $A_1$ transformation temperature under a carbon potential of from 0.5 to 1.0%; and carburizing and quenching or carbo-nitriding and quenching the steel member followed by reheating at not more than the heating temperature of pre-carburizing.

6 Claims, 2 Drawing Sheets

METHOD OF CARBURIZING SPHEROIDIZING AND QUENCHING

BACKGROUND OF THE INVENTION

This invention relates to a method of carburizing and quenching for steel members used in, for example, transmission gears of cars, which are required surface hard layers for wear-resistance and tough inner cores.

Conventionally, the method of carburizing and quenching has been used to meet the above-mentioned requirement of steel members used in transmission gears of cars. However, with the recent advent of engines of higher output and light, simplified transmissions, the need to improve a dedendum's resistance to bending fatigue failure and a tooth surface's resistance to pitting and fusion has arisen.

A conventional method of carburizing and quenching is carried out mainly to raise fatigue strength of steel members. An ideal structure of a heat-treated steel member is the mixture of martensite and some retained austenite. However, a surface hardness of an usual steel member composed of this mixed structure is at most no more than Hv800. To improve the pitting resistance and the fusion resistance of a steel member, the surface hardness of more than Hv800 is required. It is known that this requirement is met by precipitating carbide in the surface layer of a steel member.

As one of methods to meet this requirement, the carburizing and quenching method of reheating and quenching steel members after pre-carburizing and cooling has been proposed as disclosed in Japanese Pat. application Publication Gazette No. 62-24499.

This method of carburizing and quenching can precipitate carbide in the surface layer of a steel member. However, while enough carbide to achieve the surface layer hardness of more than Hv800 can be obtained, network carbide usually precipitates in the surface layer of the steel member. Network carbide precipitated in the surface layer causes stress concentration on the interface. This stress concentration leads to the reduced pitting resistance of the steel member.

Precipitation of network carbide does not occur if the cooling process after pre-carburizing is accelerated. But in this case, the amount of heat treatment deformation after carburizing and quenching with reheating a steel member becomes too large. Accordingly, the method of increasing the cooling speed after pre-carburizing is not desirable for preventing precipitation of network carbide.

SUMMARY OF THE INVENTION

The principal object Of the present invention is to obtain a steel member of superior pitting resistance by precipitating homogeneous spheroidal carbide, avoiding the precipitation of network carbide and excessive heat treatment deformation due to the accelerated cooling process. This invention relating to a carburizing and quenching method, comprises three steps of: pre-carburizing a steel member containing Cr with precipitating carbide by heating to achieve a surface carbon concentration of not less than 1%; spheroidizing the carbide obtained in the first step by holding the steel member both at a temperature slightly above the $A_1$ transformation temperature and at a temperature slightly below the $A_1$ transformation temperature under the carbon potential of 0.5% to 1.0% (the condition under which the surface carbon concentration of the steel member will be from 0.5 to 1.0%); carburizing and quenching or carbo-nitriding and quenching the steel member followed by reheating to not more than the heating temperature of precarburizing in the first step.

DETAILED DESCRIPTION OF THE INVENTION

Figure 1A:
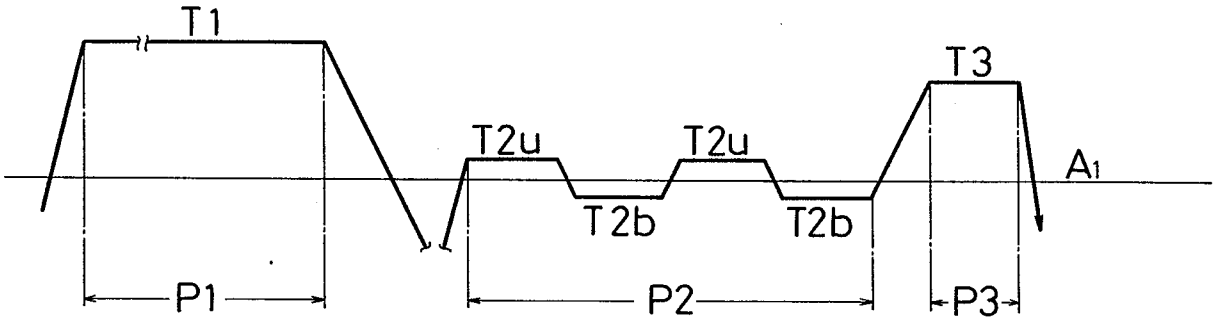
FIGS. 1(*a*), (*b*) show heat treatment patterns of concrete examples 1 and 3 respectively in this invention of the carburizing and quenching method.

Steps devised in this invention to attain the above-mentioned object of obtaining a steel member having superior pitting resistance comprises: first step of pre-carburizing a steel member containing Cr with precipitating carbide by heating to achieve a surface carbon concentration of not less than 1%; second step of spheroidizing the carbide obtained in the first step by holding the steel member alternately both at a temperature slightly above the $A_1$ transformation temperature and at a temperature slightly below the $A_1$ transformation temperature under the carbon potential of 0.5 to 1.0%; third step of carburizing and quenching or carbo-nitriding and quenching the steel member with reheating to not more than the heating temperature of pre-carburizing at the first step.

During the second step, spheroidizing the carbide obtained in the first step, when the temperature of the steel member becomes a temperature slightly above the $A_1$ transformation temperature, network carbide precipitated on the steel member during the first step of pre-carburizing is segregated into minute carbide. When the temperature of the steel member becomes slightly below the $A_1$ transformation temperature, newly precipitated carbide coheres around the minute carbide segregated. Thus, the carbide precipitated in this process is spheroid.

During the third step, carburizing and quenching or carbo-nitriding and quenching, the carbide-spheroidized steel member is reheated to not more than the precarburizing temperature. As a result, the homogeneous spheroidal carbide ranges in the surface layer of the steel member.

The following is a description of the preferred embodiment of the present invention.

Pre-carburizing is carried out at the temperature $T_1$ and under a certain atmospheric condition so that the surface carbon concentration of the steel member containing Cr becomes not less than 1%. The reason why Cr must be contained in the steel member is that Cr can improve hardenability and facilitate the generation of carbide. Desirable content of Cr is from 0.5 to 2.0%, because the depth of quenching and the amount of carbide precipitated in the surface layer of the steel member become insufficient when the content of Cr is less than 0.5%, and workability of the steel member deteriorates greatly due to excessive hardness when the content of Cr is more than 2.0%.

The reason why the steel member is pre-carburized under the condition wherein that the surface carbon concentration becomes not less than 1% is that necessary amount of carbide to raise the surface hardness of the steel member can not be obtained in the next process of cooling when the surface carbon concentration is less than 1%. Additionally, it is preferable that the surface carbon concentration is less than 3%, because, when setting the condition which the surface carbon concentration is more than 3%, the precipitation of carbide is excessive, and this results in the deteriorated toughness of the steel member, and high concentration of carburizing gas required for obtaining above mentioned 3% surface carbon concentration leads to the reduced productivity due to sooting caused in a furnace for pre-carburizing.

The next step is to precipitate carbide in the surface layer of the steel member by cooling below the $A_1$ transformation temperature (720° C). To improve the pitting resistance of the steel member with increasing surface hardness, having a range of homogeneous and minute spheroidal carbides in the surface layer without precipitating network carbide is desirable. Furthermore, the preferable amount of carbide precipitation is from 3 to 30% in its area ratio (ratio of carbide precipitating to the area), because more than Hv800 surface hardness can not be obtained when the area ratio of carbide precipitation is less than 3%, while toughness is decreased when the area ratio is more than 30%. Additionally, it is further desirable that the area ratio be from 5 to 20%.

Then, the carbide precipitated at the above-mentioned step is spheroidized in the next step. In this step, the steel member is held alternately both at a temperature slightly above the $A_1$ transformation temperature and at a temperature slightly below the $A_1$ transformation temperature under the carbon potential of 0.5 to 1.0%. The reason that the carbide becomes spheroidal under this temperature condition is as follows. Usually carbide solid solution occurs when the temperature of the steel member rises above the $A_1$ transformation temperature, and precipitation occurs when the temperature falls below the $A_1$ transformation temperature. But when the steel member is held at temperature T2*u*, slightly above the $A_1$ transformation temperature, network carbide is segregated into the retained minute carbide, and when the steel member is held at temperature T1*b*, slightly below the $A_1$ transformation temperature, carbide precipitates cohering around the retained minute carbide. Consequently, the carbide precipitated in this step takes a spheroidal form.

The reason for spheroidizing carbide under the carbon potential of the 0.5 to 1.0% range is as follows. When the carbon potential is more than 1.0%, solid solution of carbide does not occur due to excessive C in the matrix. Therefore, because network carbide can not be segregated, the formation of spheroidal carbide is not facilitated. When the carbon potential is less than 0.5%, the surface of the steel member is decarburized and particle diameter of the carbide precipitated in the surface becomes small. Therefore, sufficient surface strength cannot be obtained.

Temperature T2*u*, T2*b* which are slightly above or slightly below the $A_1$ transformation temperature respectively, should desirably be in the ±50° C. range of the $A_1$ transformation temperature. This is because when temperature T2*u* is higher than the above-mentioned desirable range, spheroidization of carbide is checked since austenite is homogenized and rough and large carbide often appears due to the reduced number of cores of carbide, and when temperature T2*b* is lower than the desirable range, carbide can not become spheroidal either. As for the holding time at each temperature T2*u* and T2*b*, slightly above and slightly below the $A_1$ transformation temperature respectively, from 80 to 60 minutes is appropriate.

The cooling speed from T2*u*, slightly above the $A_1$ transformation temperature, to T2*b*, slightly below the $A_1$ transformation temperature, should be as slow as possible. This is because higher cooling speed leads to insufficient diffusion of C and consequent re-precipitation of carbide dissolved at temperature T2*u*, slightly above the $A_1$ transformation temperature, thus hindering the spheroidization process of carbide. Therefore, the desirable cooling speed is not more than 5° C./min. and the most desirable speed is approximately 1° C./min.

As for spheroidizing the carbide, it is necessary to adjust the holding time and the number of times to hold the steel member at temperature T2*u* and T2*b*, slightly above and slightly below the $A_1$ transformation temperature respectively, depending on the surface carbon concentration of the steel member. Accordingly, holding the steel member a plural number of alternate times at each temperature of T2*u* and T2*b* preferable in some cases according to the surface carbon concentration.

The final step is to carburize and quench or carbonitride and quench the steel member carbide-spheroidized in the above-mentioned step with reheating to temperature $T_3$, not more than the heating temperature $T_1$ of pre-carburizing. The reason for setting the reheating temperature $T_3$ at not more than the heating temperature $T_1$ of pre-carburizing step is that when the reheating temperature $T_3$ is higher than the heating temperature $T_1$ of pre-carburizing, the precipitated carbide dissolves again, resulting in undesirable surface hardness of the steel member. The reheating temperature $T_3$ must be a proper quenching temperature (not less than 800° C.). In the case when the heating temperature $T_1$ of precarburizing is, for example 930° C. as in the example described later, the reheating temperature $T_3$ should desirably be from 800 to 900° C. and most desirably be from 820 to 870° C.

It is desirable to carburize and quench or carbonitride and quench the steel member under the carbon potential of not less than 0.5% in order to prevent the reduction of the amount of carbide due to decarburization in the surface of the steel member. Usually, the carbon potential of 0.8% is satisfactory. When using the method of carbo-nitriding and quenching, proper concentration of $NH_3$ gas, for example, several percent, must be added to the atmosphere of the above-mentioned carburizing gas.

Although this preferred embodiment of the invention continuously carries out each step of pre-carburizing, carbon-spheroidizing, and carburizing and quenching or carbo-nitriding and quenching, a batch process may also be adopted alternatively.

The description of concrete examples 1 to 5 of carburizing and quenching method of this invention an comparative examples 1 and 2 of conventional methods is as follows.

Three kinds of materials shown in the table 1 were used as steel members. Each of them is a rod with a 20-mm diameter.

TABLE 1

| material | C | Si | Mn | Cr | Mo |
|---|---|---|---|---|---|
| JIS SCM 420 | 1.00 | 0.24 | 0.66 | 1.02 | |
| JIS SUJ2 | 0.21 | 0.30 | 1.01 | 1.47 | 0.26 |

TABLE 1-continued

| material | C | Si | Mn | Cr | Mo |
|---|---|---|---|---|---|
| modified SCM420 | 0.17 | 0.06 | 0.78 | 1.10 | 0.80 |

(unit: %)

Figure 1B:
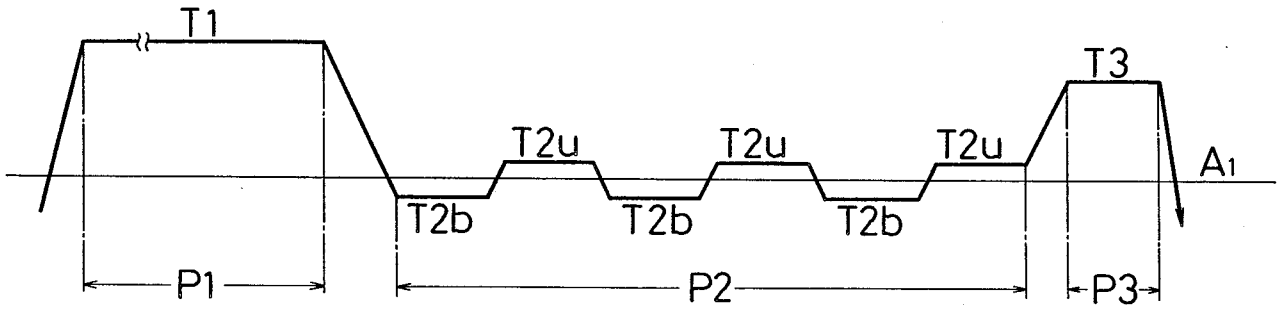

The concrete example 1 is directed to carburizing and quenching a steel member made of the material JIS-SCM420(1.02% Cr) based on the heat treatment pattern shown in FIG. 1(*a*).

This steel member was pre-carburized being held at the temperature $T_1$ of 930° C. for four hours under the carbon potential of 1.4% (indicated by $P_1$ in FIG. 1(*a*). Later, the steel member was cooled in a furnace with the cooling speed of about 1° C./min. until the temperature of the steel member reached well below the $A_1$ transformation temperature.

Then, the steel member was heated at the heating speed of about 2° C./min. until the temperature of the steel member reached the temperature T2*u* of 740° C. under the carbon potential of 0.8%. After being held at the temperature T2*u* for 30 minutes, the steel member was cooled at the cooling speed of about 1° C./min. until the temperature of the steel member reached the temperature T2*b* of 680° C., and then held at this temperature T2*b* for 30 minutes. Next, the steel member was held alternately at the temperature T2*u* and T2*b*, slightly above and slightly below the $A_1$ transformation temperature (indicated by $P_2$ in FIG. 1(*a*). In this way, the steel member was held two times in total alternately at the temperature T2*u* and T2*b*.

Next, under the carbon potential of 0.8%, the steel member was heated until its temperature reached the temperature $T_3$ of 870° C. and held at this temperature $T_3$ for 30 minutes and then quenched (indicated by $P_3$ in FIG. 1(*a*) ).

The concrete example 2 is directed to carburizing and quenching the steel member made of the material JIS-SUJ2(1.47% Cr).

Under the carbon potential of 2.2%, this steel member was first pre-carburized being held at the same temperature and the same hours as the concrete example 1, and then carbide-spheroidized and carburized and quenched under the same condition as the concrete example 1.

The concrete example 3 is directed to carburizing and quenching the steel member made of the material of modified SCM420 based on the heat treatment pattern shown in FIG. 1(*b*).

This steel member was first pre-carburized being held at the temperature $T_1$ of 930° C. for 4 hours under the carbon potential of 1.8% (indicated by $P_1$ in FIG. 1(*b*) and then cooled in a furnace at the cooling speed of about 1° C./min. until the temperature of the steel member reached the temperature T2*b* of 680° C., below the $A_1$ transformation temperature.

After being held at the temperature T2*b* of 680° C. for 30 minutes under the carbon potential of 0.8%, the steel member was heated at the speed of about 1° C./min. until the temperature of the steel member reached the temperature T2*u* of 740° C., slightly above the $A_1$ transformation temperature and then held at this temperature T2*u* for 30 minutes. Next, the steel member was held two times alternately at the temperature T2*u* and T2*b*, slightly above and slightly below the $A_1$ transformation temperature (indicated by $P_2$ in FIG. 1(*b*) ). In this way, the steel member was held three times in total alternately at the temperature T2*u* and T2*b*.

Finally, under the carbon potential of 0.8%, the steel member was heated until the temperature of the steel member reached the temperature $T_3$ of 870° C. and held at the temperature $T_3$ for 30 minutes, and then quenched (indicated by $P_3$ in FIG. 1(*b*) ).

The concrete example 4 is directed to carburizing and quenching the steel member of the same material as concrete example 1.

The steel member was pre-carburized and quenched, and carbide-spheroidized under the same conditions as in concrete example 1.

Then, the steel member was carbo-nitrided and quenched under the carbon potential of 0.8% with the following processes of: heating until the temperature of the steel member reached the temperature $T_3$ of 840° C.; adding $NH_3$gas until nitrogen potential reached 0.1% holding at the temperature $T_3$ for 30 minutes, and being quenched.

The concrete example 5 is adding $NH_3$ gas to achieve nitrogen potential of 0.3% during the step of carbo-nitriding and quenching in the carburizing and quenching treatment of the concrete example 4.

The comparative example 1 is carburizing and quenching the same steel member JIS-SCM420 as the concrete example 1.

The steel member was pre-carburized being held at the temperature $T_1$ of 930° C. for 4 hours under the same carbon potential of 1.4% as in concrete example 1. Then the steel member was cooled in a furnace at the cooling speed of 1° C./min. until the temperature of the steel member reached room temperature.

Then the steel member was carburized and quenched by heating until the temperature of the steel member reached the temperature $T_3$ of 870° C., and holding at the temperature$T_3$ for 30 minutes, and quenching.

Unlike comparative example 1, comparative example 2 is directed to quenching the steel member instead of cooling it in a furnace.

Figure 2A:
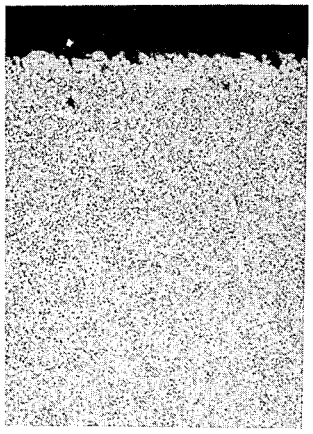
FIGS. 2(*a*), (*b*) are micrographs of metallic structures of steel members obtained from the concrete example 1 and the comparative example 1.
Figure 2B:
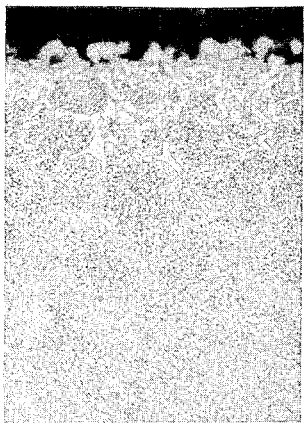

Micrographs of metallic structure of the steel members (Magnification 460x) obtained from the above-mentioned concrete example and comparative example are shown in FIG. 2(*a*) and (*b*) respectively. As clearly shown in FIG. 2(I a), the metallic structure of concrete example 1 has a range of almost homogeneous and minute spheroidal carbide while the metallic structure of comparative example 1 has precipitation of network carbide as shown in FIG. 2(*b*).

Table 2 shows results of various tests conducted for concrete examples 1 to 5 and comparative examples 1 and 2.

TABLE 2

| | spheroidal carbide | surface hardness 25 μm depth | surface hardness 25 μm depth 250° C. tempering | carbide range | area ratio of carbide depth 25 μm | area ratio of carbide depth 100 μm | pitting resistance (pitting occurance life test) |
|---|---|---|---|---|---|---|---|
| concrete example 1 | precipitated | Hv850 | Hv770 | homogeneous spheroidal | 13% | 13% | $5.9 \times 10^6$ |
| concrete | precipitated | Hv890 | Hv830 | homogeneous | 23% | 17% | $8.5 \times 10^6$ |

TABLE 2-continued

| | spheroidal carbide | surface hardness 25 μm depth | surface hardness 25 μm depth 250° C. tempering | carbide range | area ratio of carbide depth 25 μm | 100 μm | pitting resistance (pitting occurance life test) |
|---|---|---|---|---|---|---|---|
| example 2 concrete | precipitated | Hv870 | Hv820 | spheroidal homogeneous | 17% | 13% | |
| example 3 concrete | precipitated | Hv830 | Hv800 | spheroidal homogeneous | 16% | 15% | |
| example 4 concrete | precipitated | Hv820 | Hv800 | spheroidal homogeneous | 16% | 16% | $8.7 \times 10^6$ |
| example 5 comparative | not precipitated | Hv860 | Hv790 | spheroidal network | 25% | 10% | $1.2 \times 10^6$ |
| example 1 comparative example 2 | not precipitated | hv850 | Hv750 | homogeneous spheroidal | 9% | 7% | |

Column 4 of the table 2 shows an evaluation of softening resistance as substitution for pitting resistance. Data are expressed by surface hardness of &he steel members when they were tempered after being held at the temperature of 250° C. for one hour. Column 8 of the table 2 shows the results of roller pitting test conducted to evaluate pitting resistance. For this test, rollers with diameter of 26 mm were used instead of rods with diameter of 20 mm. Carburizing and quenching treatments used in concrete example 1 , 2 and 5, and the comparative example 1 were applied to these rollers. A pitting occurrence life test was conducted for these rollers under the test conditions of plane pressure=393kgf/mm$^2$, slip ratio=60%, and lubricating oil=ATF(90° C.).

Table 3 shows results of heat treatment deformation test for real gears. Gears made of the material JIS-SCM420 with module=2.25, number of teeth=19, and width of tooth=31.5 mm were prepared for the test. The treatments of carburizing and quenching used in the concrete example 1 and the comparative example 2 were applied to these gears. Values in the table show the amount of heat treatment deformation obtained from values of accuracy measured before and after the treatment.

TABLE 3

| | tooth form deformation | tooth trace deformation |
|---|---|---|
| concrete example 1 | −5 μm | −8 μm |
| comparative example 2 | −13 μm | −21 μm |

In this invention, spheroidization of carbide carried out between the step of pre-carburizing and the step of carburizing and quenching or carbo-nitriding and quenching leads to the homogeneous range of spheroidal carbide in the surface layer of the steel member. Therefore, using this feature of the invention, the steel member of not less than Hv800 surface hardness, superior pitting resistance and reduced heat treatment deformation can be reliably obtained.

What is claimed is:

1. A method of carburizing end quenching, comprising the steps of:

a. pre-carburizing a steel member containing Cr with precipitating carbide by heating to a temperature, $T_1$, to achieve a surface carbon concentration of not less than 1%;

b. spheroidizing carbide obtained in step a, by alternately holding said steel member both at one temperature T2*u*, slightly above and then another temperature, T2*b*, slightly below the $A_1$ transformation temperature under the carbon potential of from 0.5 to 1 0%: and c. carburizing and quenching or carbo-nitriding and quenching said steel member followed by heating to a reheating temperature, $T_3$, not greater than $T_1$.

2. The method of carburizing and quenching as claimed in claim 1 wherein said steel member contains from 0.5 to 2.0 weight percent of Cr.

3. The method of carburizing and quenching as claimed in claim 1 wherein $T_3$ less than $T_1$, and T2*u* is less than $T_3$.

4. The method of carburizing and quenching as claimed in claim 1 wherein said steel member is held for plural number of times alternately at T2*u* and T2*b* in the step of said carbide-spheroidization.

5. The method of carburizing and quenching as claimed in claim 1 wherein both T2*u* and T2*b* are within a range of +50° C. of the $A_1$ transformation temperature.

6. The method of carburizing and quenching as claimed in claim 1 wherein in the step of carbide-spheroidization, the speed of cooling from $T_1$, to T2*b* is not greater than 5° C./min.

* * * * *